US009933735B2

(12) United States Patent
Gon

(10) Patent No.: US 9,933,735 B2
(45) Date of Patent: Apr. 3, 2018

(54) FIXING DEVICE AND IMAGE FORMING APPARATUS

(71) Applicant: KYOCERA Document Solutions Inc., Osaka (JP)

(72) Inventor: Shoko Gon, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/348,500

(22) Filed: Nov. 10, 2016

(65) Prior Publication Data

US 2017/0160683 A1 Jun. 8, 2017

(30) Foreign Application Priority Data

Dec. 3, 2015 (JP) ..... 2015-236640

(51) Int. Cl.
*G03G 15/20* (2006.01)

(52) U.S. Cl.
CPC ..... *G03G 15/2053* (2013.01)

(58) Field of Classification Search
CPC ..... G06F 3/044; G06F 1/3209; G06F 1/3243; G06F 2203/04108; G06F 2203/04111; G06F 2203/04112; G06F 3/016; G06F 3/03545; G06F 3/0412; G06F 3/0414; G06F 3/0416; G06F 3/167; G03G 15/2053; G05D 1/00; H01L 2924/00; H01L 2924/00014; H01L 2224/45144; H01L 2224/48091; H01L 2924/12041; H01L 2924/12042; H01L 2924/14; H01L 2924/15787; H01L 2924/181; H01L 2924/351; H01L 2224/45015; H01L 23/5256
See application file for complete search history.

(56) References Cited

U.S. PATENT DOCUMENTS

2013/0302046 A1* 11/2013 Monde ..... G03G 15/205 399/33

FOREIGN PATENT DOCUMENTS

JP 2006-267332 A 10/2006
JP 2010-054666 A 3/2010

* cited by examiner

*Primary Examiner* — Roy Y Yi
(74) *Attorney, Agent, or Firm* — Studebaker & Brackett PC

(57) ABSTRACT

A fixing device includes a fixing belt, a belt guide, a pressuring member, a heat source and an excessive temperature rise preventing device. The guide contacts with the inside of the belt to assist the belt's rotation track. The heat source is located across the belt to the pressuring member to induction-heat the belt. The preventing device has first and second lead wires connected at one and another end sides in an axial direction of the belt and prevents excessive temperature rise of the guide in noncontact. The first lead wire is extended to one end side and pulled out from the inside to the outside via one end side in the belt. The second lead wire is extended to another end side, curved toward one end side, extended to one end side and pulled out from the inside to the outside via one end side in the belt.

12 Claims, 9 Drawing Sheets

FIXING DEVICE AND IMAGE FORMING APPARATUS

INCORPORATION BY REFERENCE

This application is based on and claims the benefit of priority from Japanese Patent application No. 2015-236640 filed on Dec. 3, 2015, the entire contents of which are incorporated herein by reference.

BACKGROUND

The present disclosure relates to a fixing device for fusing and fixing an unfixed toner on a recording medium onto a sheet and an image forming apparatus, such as a copying machine, a printer and a facsimile, including this fixing device.

An image forming apparatus of an electrographic manner, such as a copying machine or a printer, includes a fixing device for fixing a toner image onto a recording medium, such as a sheet. In the fixing device, considering worm-up time shortening and energy saving, as a heat source fusing a toner, a heat source in an induction heating (IH) manner is applied. The heat source in the IH manner makes magnetic flux generated by a coil act on a heating member, such as a fixing belt, to heat the heating member. The coil is configured to be wound along a rotation axial direction of the heating member outside the heating member and coil configuration of such a form is called as a "external capsuling type (axial direction wound) coil". The external capsuling type coil is formed in a shape along a curved face of the heating member, thereby maintaining a distance between the coil and the heating member constant to secure heat generation performance of the heating member.

The heating member is configured so that the fixing belt is put between an internal member of the fixing belt and an external pressuring roller and parts the fixing belt and the internal member are slid to rotate the fixing belt. The IH manner using such a sliding belt is called as a sliding belt IH manner. In the sliding belt IH manner, by suitably designing function-separation of the internal member of the fixing belt, the fixing device having low heat capacity and shortening the worm-up time is achieved. In the fixing device in the sliding belt IH manner, electrical components, such as a thermostat or a thermistor, can be located inside the fixing belt.

For example, an image heading device in an electromagnetic induction heating manner using a heating belt is known. Then, a temperature sensor is located at a location having a highest heating value in a heating belt and, in an area at where a magnetic field of the heating belt is weakened by a coil, opening widths of an internal core and a pressuring stay are made narrower than an inside width of the coil, and a signal line is located inside the internal core.

Moreover, a fixing device bringing an unfixed toner image into contact with an endless fixing belt and heating and fusing it to crimp it onto a recording medium is known. In the fixing device, an outside magnetic member and an inside magnetic member are located so as to face to each other inside and outside an excitation coil. Then, each magnetic member is composed of a plurality of divided blocks and they are located in a staggered pattern so as to complement spaces between the blocks of both the magnetic members at constant intervals. In addition, temperature detecting member and an energization interrupting member are located between the block of the magnetic member.

However, in a case of locating the electric components inside the fixing belt, it is necessary to take measures so that magnetic flux generated by temperature inside the fixing belt and the coil does not affect the electric components. Although almost the magnetic flux generated by the coil is absorbed by the fixing belt and a belt guide supporting this fixing belt and converted to heat, a part may penetrate the fixing belt and the belt guide as leaked magnetic flux. Approximately 80% of the magnetic flux generated by the coil is absorbed by a belt base material of the fixing belt and converted to eddy current and almost remained magnetic flux penetrates the fixing belt and is absorbed by the belt guide and converted to eddy current. In the sliding belt IH manner, it is necessary to make the fixing belt being equal to or thinner than. A thickness capable of maintaining flexibility and it is preferable to make the belt guide in a thickness of nearly 0.2 mm in order to reduce spring performance and heat capacity of the fixing belt as low as. Accordingly, because the magnetic flux leaked inside the fixing belt does not become completely 0, there is a slightly magnetic flux leaked inside the fixing belt. Subsequently, electromagnetic noise may occur by the leaked magnetic flux to affect wiring of a lead wire pulled out from the electric components located inside the fixing belt.

As the electric components, for example, there are a temperature sensor, such as a thermistor contacting the inside of the fixing belt, a safety element, such as a temperature fuse contacting the inside of the fixing belt, and others. As mentioned above, a configuration reducing an effect of the electromagnetic noise by locating the wiring of the electric components at an area less affected by the leaked magnetic flux is proposed.

Incidentally, in the sliding belt IH manner, a thermostat is applied as the safety element. The thermostat is generally wired by pulling out lead wires from both sides of a temperature sensing part, such as bimetal. If the thermostat is located inside the fixing belt, the lead wires are pulled out from both ends of the fixing belt, and then, routed so as to surround a belt unit, thereby making large loops. The wiring of the lead wired with such large loops causes easily interlinkage of the leaked magnetic flux from the coil, that is, is easily affected by the electromagnetic noise generated by the leaked magnetic flux, and therefore, the electromagnetic noise becomes large relatively.

SUMMARY

In accordance with an embodiment of the present disclosure, a fixing device includes a fixing belt, a belt guide, a pressuring member, a heat source and an excessive temperature rise preventing device. The fixing belt is provided rotatably around a rotation axis. The belt guide is brought into contact with the inside of the fixing belt to assist a rotation track of the fixing belt. The pressuring member is provided rotatably and brought into pressure contact with the fixing belt to form a fixing nip. The heat source is located at an opposite side to the pressuring member across the fixing belt separately from the fixing belt to the outside and composed of a coil induction-heating the fixing belt. The excessive temperature rise preventing device is provided with respect to the belt guide in a noncontact manner inside the belt guide, has a first lead wire and a second lead wire connected at one end side and another end side in an axial direction of the fixing belt and prevents excessive temperature rise of the belt guide. The first lead wire is wired as to be extended to one end side in the axial direction of the fixing belt and to be pulled out from the inside to the outside via one end side in the fixing belt. The second lead wire is wired so as to be extended to another end side in the axial direction of the fixing belt and then to be curved toward one end side in the axial direction, and further, to be extended to one end side in the axial direction of the fixing belt and to be pulled out from the inside to the outside via one end side in the fixing belt.

In accordance with an embodiment of the present disclosure, an image forming apparatus includes the above-mentioned fixing device.

The above and other objects, features, and advantages of the present disclosure will become more apparent from the following description when taken in conjunction with the accompanying drawings in which preferred embodiment of the present disclosure is shown by way of illustrative example.

DETAILED DESCRIPTION

Figure 1:
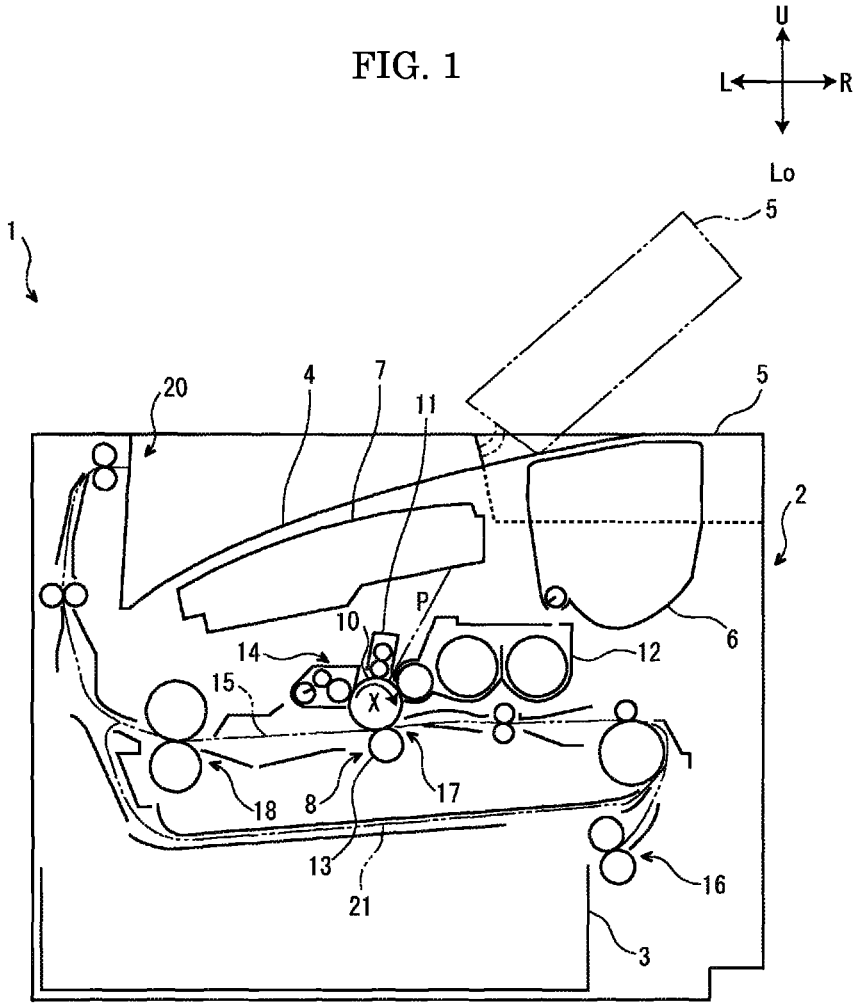
FIG. 1 is a sectional view schematically showing a printer according to an embodiment of the present disclosure.

First, with reference to FIG. 1, the entire structure of a printer 1 (an image forming apparatus) will be described. Hereinafter, for convenience of explanation, it will be described so that the front side of the printer 1 is positioned at a near side of a paper sheet of FIG. 1. Arrows Fr, Rr, L, R, U and Lo in each of the drawings respectively indicate a front side, a rear side, a left side, a right side, an upper side and a lower side of the printer 1.

The printer 1 includes a box-like formed printer main body 2. In a lower part of the printer main body 2, a sheet feeding cartridge 3 storing sheets (recording mediums) is installed. In an upper face of the printer main body 2, an ejected sheet tray 4 is formed. In the upper face of the printer main body 2, an upper cover 5 is openably/closably attached at a lateral side of the ejected sheet tray 4. Below the upper cover 5, a toner container 6 is installed.

In an upper part inside the printer main body 2, an exposure device 7 composed of a laser scanning unit (LSU) is located below the ejected sheet tray 4. Below the exposure device 7, an image forming part 8 is arranged. In the image forming part 8, a photosensitive drum 10 as an image carrier is rotatably arranged. Around the photosensitive drum 10, a charging device 11, a development device 12, a transfer roller 13 and a cleaning device 14 are located along a rotating direction (refer to an arrow X in FIG. 1) of the photosensitive drum 10.

Inside the printer main body 2, a conveying path 15 for the sheet is arranged. At an upstream end of the conveying path 15, a sheet feeding part 16 is positioned. At an intermediate stream part of the conveying path 15, a transferring part 17 composed of the photosensitive drum and the transfer roller 13 is positioned. At a downstream part of the conveying path 15, a fixing device 18 is positioned. At a downstream end of the conveying path 15, a sheet ejecting part 20 is positioned. Below the conveying path 15, an inversion path 21 for duplex printing is arranged.

Next, image forming operation of the printer 1 including such a configuration will be described.

When the power is supplied to the color printer 1, various parameters are initialized and initial determination, such as temperature determination of the fixing device 18, is carried out. Subsequently, in the printer 1, when image data is inputted and a printing start is directed from a computer or the like connected with the printer 1, image forming operation is carried out as follows.

First, the surface of the photosensitive drum 10 is electrically charged by the charging device 11. Then, photographic exposure corresponding to the image data is carried out to the photosensitive drum 10 by a laser light (refer to a two-dot chain line P in FIG. 1) from the exposure device 7, thereby forming an electrostatic latent image on the surface of the photosensitive drum 10. The electrostatic latent image is developed to a toner image with a toner by the development device 12.

On the other hand, the sheet picked up from the sheet feeding cartridge 3 by the sheet feeding part 16 is conveyed to the transferring part 17 in a suitable timing for the above-mentioned image forming operation. In the transferring part 17, the toner image on the photosensitive drum 10 is transferred onto the sheet. The sheet with the transferred toner image is conveyed to a downstream side in the conveying path 15 to go into the fixing device 18. In the fixing device 18, the toner image is fixed on the sheet. The sheet with the fixed toner image is ejected from the sheet electing part 20 to the sheet elected tray 4. Incidentally, the toner remained on the photosensitive drum 10 is collected by the cleaning device 14.

Next, the fixing device 18 will be described with reference to FIG. 2 to FIG. 7.

Figure 2:
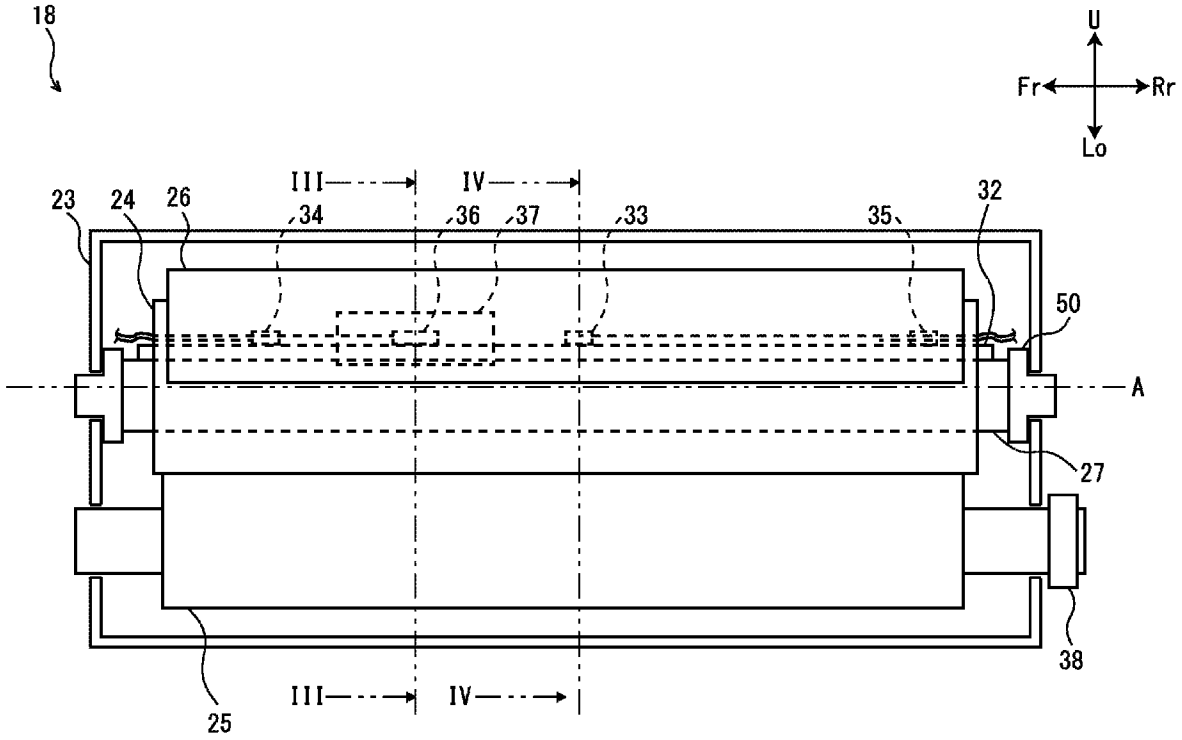
FIG. 2 is a sectional view showing a fixing device as viewed from a right side according to the embodiment of the present disclosure.

As shown in FIG. 2 and other figures, the fixing device 18 includes a box-like formed frame 23, a fixing belt 24, a pressuring roller 25 (a pressuring member), a heat source 26, a supporting stay 27 (a supporting member), a pressing pad 28 (a pressing member), a sliding sheet. 30, a belt guide 31, an electric component holder 32 (a holder), a first thermistor 33 (a temperature sensing device), a second thermistor 34 (a temperature sensing device), a third thermistor 35 (a temperature sensing device), a thermostat 36 (an excessive temperature rise preventing device) and an electro conductive magnetic shielding member 37 (a shielding member).

Figure 3:
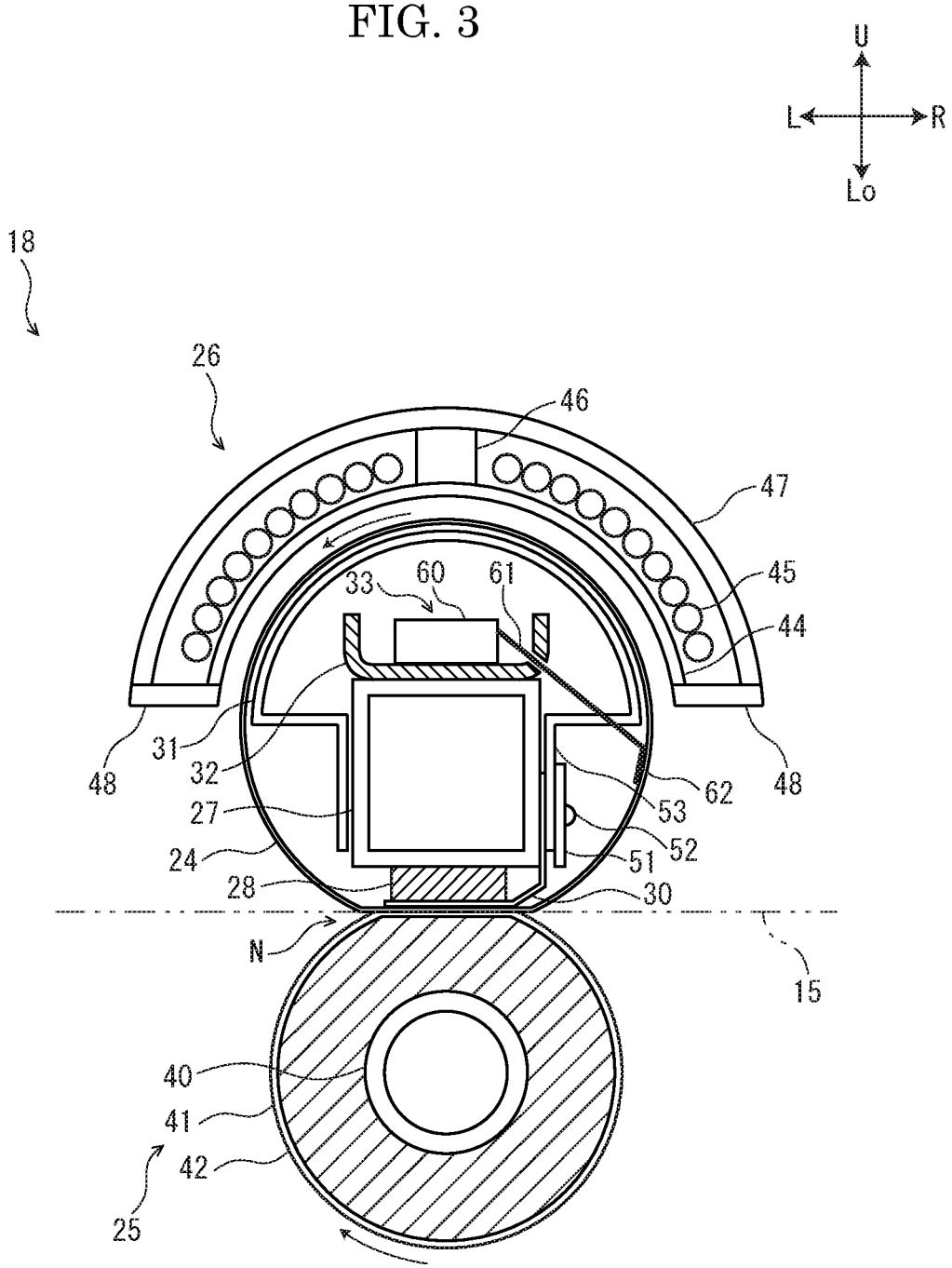
FIG. 3 is a sectional view along line FIG. 2.
Figure 4:
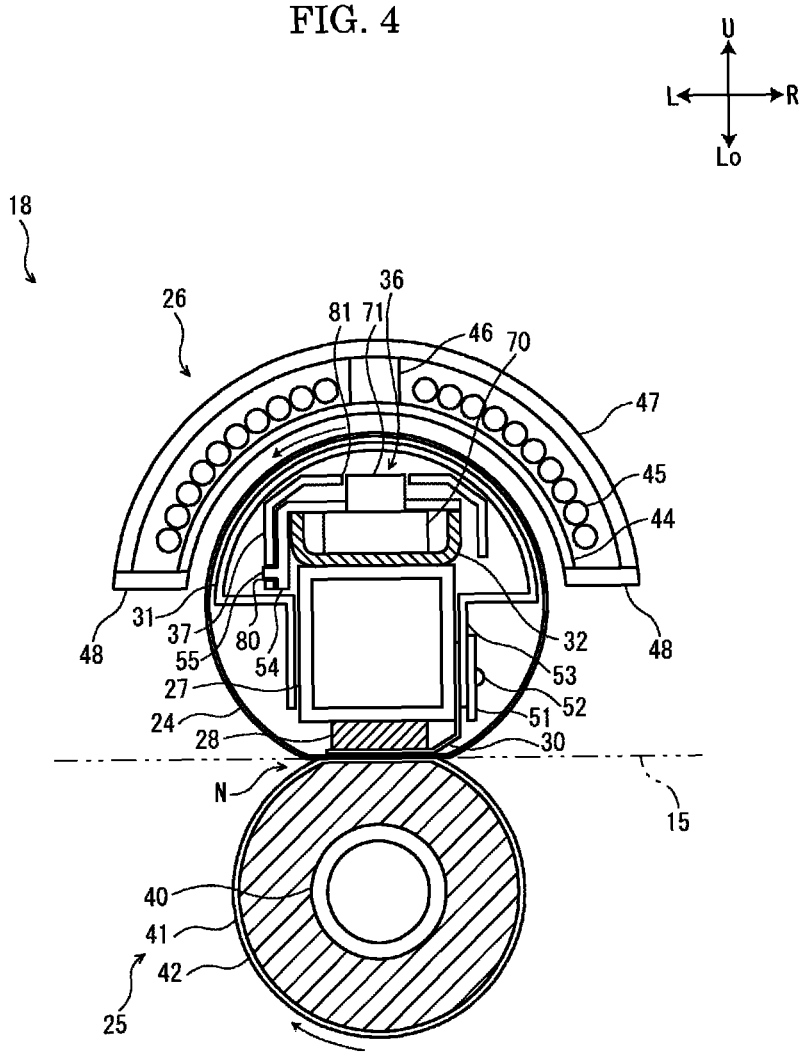
FIG. 4 is a sectional view along IV-IV line in FIG. 2.

The fixing belt 24 and the pressuring roller 25 are respectively located, as shown in FIGS. 3 and 4, at an upper side and a lower side across the conveying path 15.

The fixing belt 24 is elongated in a sheet width direction (forward and backward directions) being orthogonal to (crossing) a sheet conveyance direction (left and right directions). The fixing belt 24 has a roughly cylindrical shape being endless in a circumference direction. The fixing belt 24 has, for example, a diameter of approximately 30 mm. The fixing belt 24 is mounted rotatable around a rotation axis A elongated in the forward and backward directions. In the embodiment, the forward and backward directions are a rotation axial direction of the fixing belt 24. Incidentally, the fixing belt 24 is a sliding belt sliding and rotating in accordance with rotation of the pressuring roller 25. The fixing belt 24 is also used as a heating belt induction-heated by the heat source 26 as described below.

The fixing belt 24 has elasticity and is composed of, for example, a base material layer, an elastic layer provided around the base material layer and a release layer covering the elastic layer. The base material layer of the fixing belt 24 is formed of, for example, metal, such as nickel (nickel electric casting) or steel use stainless (SUS), and has a thickness of approximately 30-50 μm. An inner circumference face of the base material layer of the fixing belt 24 is coated by a resin, such as PI (Polyimide) or PIPE (Polytetrafluoroethylene), and thereby, is configured to restrain sliding abrasion. The elastic layer of the fixing belt 24 is formed of, for example, silicone rubber and has a thickness of approximately 200-500 μm. The release layer of the fixing belt 24 is formed of, for example, PFA (Perfluoro alkoxy alkane). Incidentally, in each of the figures, the respective layers (the base material layer, the elastic layer, the release layer) of the fixing belt 24 are represented. Without being distinguished from each other in particular.

The pressuring roller 25 is formed in a roughly columnar elongated in the forward and backward directions and is attached rotatably. The pressuring roller 25 is brought into pressure contact with an outer circumference face of the fixing belt 24, thereby forming a fixing nip N between the fixing belt 24 and the pressuring roller 25. To a rear end part of the pressuring roller 25, a driving gear 38 is coaxially fixed. The pressuring roller 25 is connected to a driving source (not shown), such as a motor, via this driving gear 38 and is driven and rotated by this driving source.

The pressuring roller 25 is composed of, for example, a columnar core material 40, an elastic layer 41 provided around the core material 40 and a release layer 42 covering the elastic layer 41. The core material 40 of the pressuring roller 25 is formed of, for example, metal, such as steel use stainless (SUS) or aluminum, and this core material 40 becomes a rotation shaft of the pressuring roller 25. The elastic layer of the pressuring roller 25 is formed of, for example, a silicone rubber and has a thickness of approximately 3-5 mm. The release layer of the pressuring roller 25 is formed of, for example, PFA (Perfluoro alkoxy alkane).

The heat source 26 has an external capsuling shape covering the fixing belt. 24 from the upper side and is located at the upper side (the outside) of the fixing belt 24. In other words, the heat source 26 is located separately from the fixing belt 24 to the outside at a predetermined interval at an opposite side to the pressuring roller 25 across the fixing belt 24. The heat source 26 includes a bobbin 44, a coil 45, a center core 46, an arch core 47 and two side cores 48, The heat source 26 is an TH (Induction Heating) fixing unit generating magnetic flux by supplying current. To the coil 45 and induction-heating the fixing belt 24 by making this magnetic flux act on the fixing belt 24.

The bobbin 44 is a plate member elongated in the rotation axial direction of the fixing belt 24 and having a cross section of an arc shape along a shape of a curved face (an upper side of the outer circumference face) of the fixing belt 24. The coil 45 is wound along the rotation axial direction of the fixing belt 24 on an outer diameter side' face (the outer circumference face) of the arc shape of the bobbin 44. That is, the coil 45 is an external capsuling type coil formed along the shape of the curved face (the upper side of the outer circumference face) of the fixing belt 24. The coil 45 is an IH coil generating the magnetic flux by supplying the current as described above.

The center core 46, the arch core 47 and the side cores 48 compose a ferrite member guiding the magnetic flux generated by the coil 45 to the fixing belt 24. Incidentally, the bobbin 44, the center core 46, the arch core 47 and the two side cores 48 are also used as a case storing the coil 45.

The center core 46 has an elongated shape in the rotation axial direction of the fixing belt 24 and is located at the center in the left and right directions on the outer circumference face of the bobbin 44. The arch core 47 is a plate member elongated in the rotation axial direction of the fixing belt 24 and having a cross section of an arc shape with an outer diameter larger than the bobbin 44 so as to cover the bobbin 44 and the coil 45. The arch core 47 is located at an upper side (the outside) of the bobbin 44 and the coil 45, in other words, located at an opposite side to the fixing belt. 24 across the coil 45. Each side core 48 has an elongated shape in the rotation axial direction of the fixing belt 24. The two side cores 48 are located at both end sides of the bobbin 44 (both end sides of the arch core 47) and each side core 48 is located over each end part of the bobbin 44 and each end part of the arch core 47 so as to close a gap between the bobbin 44 and the arch core 47.

Incidentally, in the heat source 26, a coil bobbin is configured so that the center core and the two side cores are located at predetermined position with respect to the bobbin 44. Moreover the arch core 47 is located at a predetermined position in an arch core holder (not shown). Further, an aluminum cover (not shown) is located so as to cover this arch core holder.

The supporting stay 27 is formed in a roughly rectangular tube shape elongated in the forward and backward directions and is made of, for example, metal, such as SUS. The supporting stay 27 is located at the roughly center inside the fixing belt 24. At both ends of the supporting stay 27, flanges 50 are provided and, if the flanges 50 are fixed to the frame 23, the supporting stay 27 is fixed to the frame 23. The supporting stay 27 is a member supporting the pressing pad 28 and is also used as a base member to which the sliding sheet 30, the belt guide 31 and the electric component holder 32 are attached.

The pressing pad 28 is formed in a roughly rectangular columnar shape elongated in the forward and backward directions and is made of, for example, heat resistant resin, such as LCP (Liquid Crystal Polymer). The pressing pad 28 is arranged at a lower side of the supporting stay 27 inside the fixing belt 24, its upper face is supported by the supporting stay 27 and its lower face is located to press a lower side of the inner circumference face of the fixing belt 24 to the lower side (a side of the pressuring roller 25). In other words, the pressing pad 28 is a member forming the fixing nip N by pressing the pressuring roller 25 via the fixing belt 24 and nipping and conveying the fixing belt 24 together with the pressuring roller 25.

The sliding sheet 30 is a sheet elongated in the forward and backward directions to have a lower friction coefficient and better sliding performance than the pressing pad 28 and is made of, for example, fluorine-based resin, such as PTFE. The sliding sheet 30 is extended from a side face (a right side face) of the supporting stay 27 to the lower side inside the fixing belt 24 and is located so as to be inserted between the inner circumference face of the fixing belt 24 and the pressing pad 28. The sliding sheet 30 is pressed by a supporting plate 51 with respect to the side face (the right side face) of the supporting stay 27 and fastened by a screw 52. The sliding sheet 30 is a member reducing sliding resistance between the inner circumference face of the fixing belt 24 and a sliding face of the pressing pad and restraining abrasion of the inner circumference face of the fixing belt 24 and the sliding face of the pressing pad 28.

The belt guide 31 is formed in a roughly semicircle tube shape elongated in the forward and backward directions with a thickness of approximately 0.2 mm, for example, by material of magnetic shunt metal or the like, such as Fe—Ni alloy, heating by the magnetic flux generated by the coil 45 to have a cross section of an arc shape along an upper side of the inner circumference face of the fixing belt 24. The belt guide 31 has an opening over the forward and backward directions at the center of its lower face and this opening has an area capable of inserting the supporting stay 27. In edge parts at both left and right sides of the opening of the belt guide 31, protruded parts 53 protruding to the lower side are formed.

The belt guide 31 is located inside the fixing belt 24 and at the upper side of the supporting stay 27 so that an arc formed outer circumference face of the belt guide 31 is along the upper side of the inner circumference face of the fixing belt 24 and is brought into contact with the inside of the fixing belt 24 in order to assist and to stabilize a rotation track of the fixing belt 24. The belt guide 31 is attached to the supporting stay 27 by fastening the right protruded part 53 together with the sliding sheet 30 by the supporting plate 51 and the screw 52. Moreover, the belt guide 31 has a function assisting heating by absorbing leaked magnetic flux penetrated the fixing belt 24 and has a function reducing leaked magnetic flux to the inside of the belt guide 31.

The electric component holder 32 is elongated in the forward and backward directions, attached to an upper face of the supporting stay 27 and located inside the belt guide 31. The electric component holder 32 is a member attaching and holding electric components of the first thermistor 33, the second thermistor 34, the third thermistor 35 and the thermostat. 36 and wirings of these and others. Moreover, in the electric component holder 32, at an attachment position of the thermostat 36, e.g. between the first thermistor 33 and the third thermistor 35 in the forward and backward directions, an attachment plate 54 is provided and, at a left side face of the attachment plate 54, engaging protruded parts 55 are formed.

Figure 5:
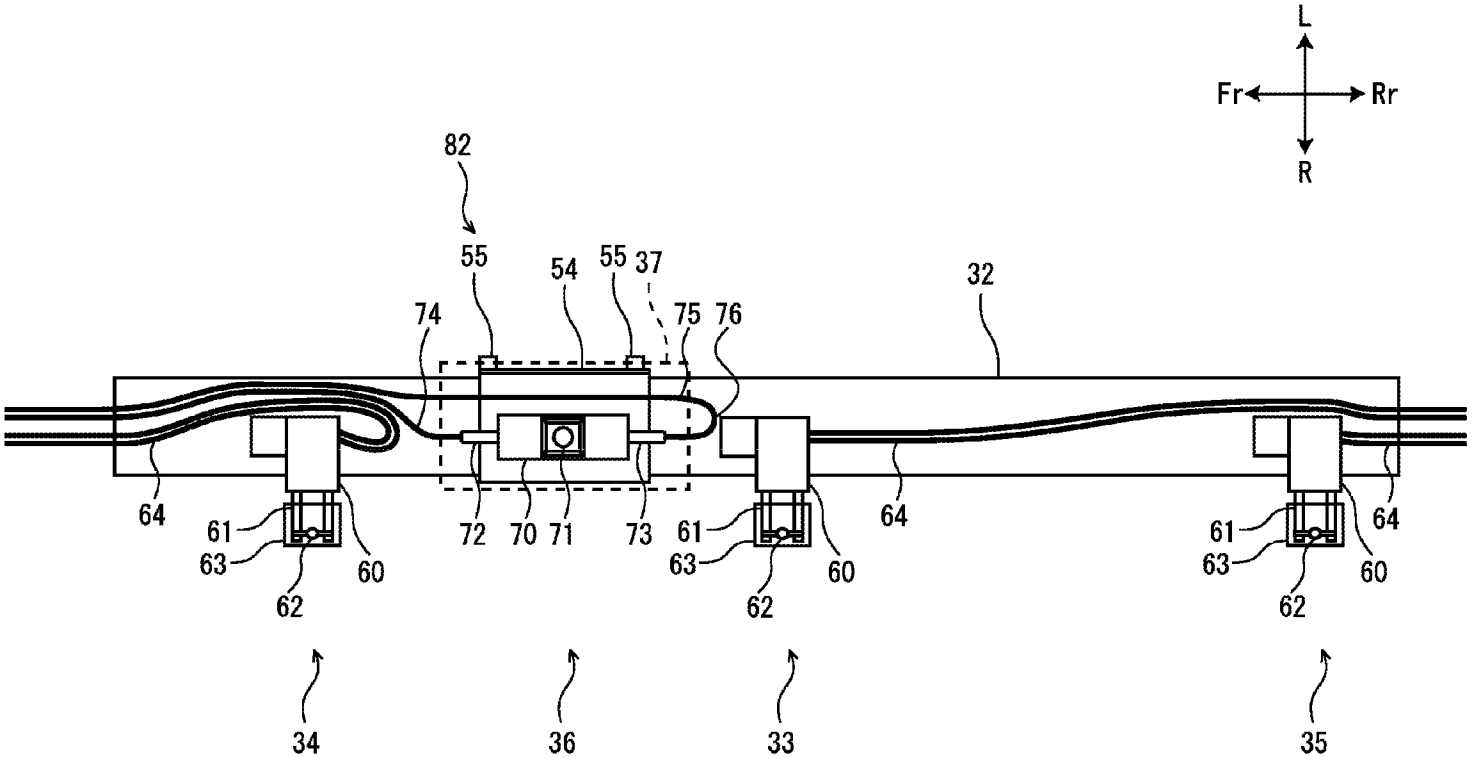
FIG. 5 is a plane view showing an electrical component holder of the fixing device according to the embodiment of the present disclosure.

As shown in FIG. 5 and other figures, the first thermistor 33 is attached in the vicinity of the center in a width direction (in the vicinity of the center in the forward and backward directions) of the sheet passing through the fixing belt 24 on an upper face of the electric component holder 32. The first thermistor 33 is a temperature sensor for main control of belt temperature of the fixing belt 24.

The second thermistor 34 is attached at a corresponding position to the outside (a non-sheet passing area) in the width direction of the sheet, when the longitudinal direction of the sheet (e.g. the sheet of A4 size) is set as the conveyance direction and the sheet passes through the fixing belt 24, on the upper face of the electric component holder 32. The second thermistor 34 is a temperature sensor for monitoring temperature of the non-sheet passing area of the fixing belt 24 when the sheet of the longitudinal size passes through and preventing excessive temperature rise.

The third thermistor 35 is attached at a corresponding position to the outside (a non-sheet passing area) in the width direction of the sheet, when the sheet of a maximum size treated in the printer 1 passes through the fixing belt 24, on the upper face of the electric component holder 32. The third thermistor 35 is a temperature sensor for monitoring temperature of the non-sheet passing area of the fixing belt 24 when the sheet of the maximum size passes through and preventing excessive temperature rise.

Figure 6:
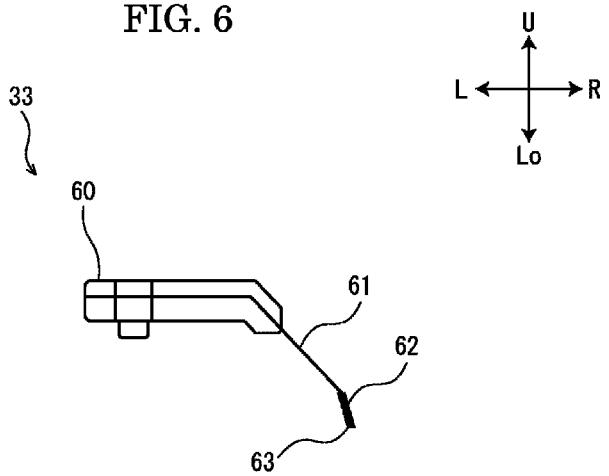
FIG. 6 is a front view showing a thermistor of the fixing device according to the embodiment of the present disclosure.
Figure 7:
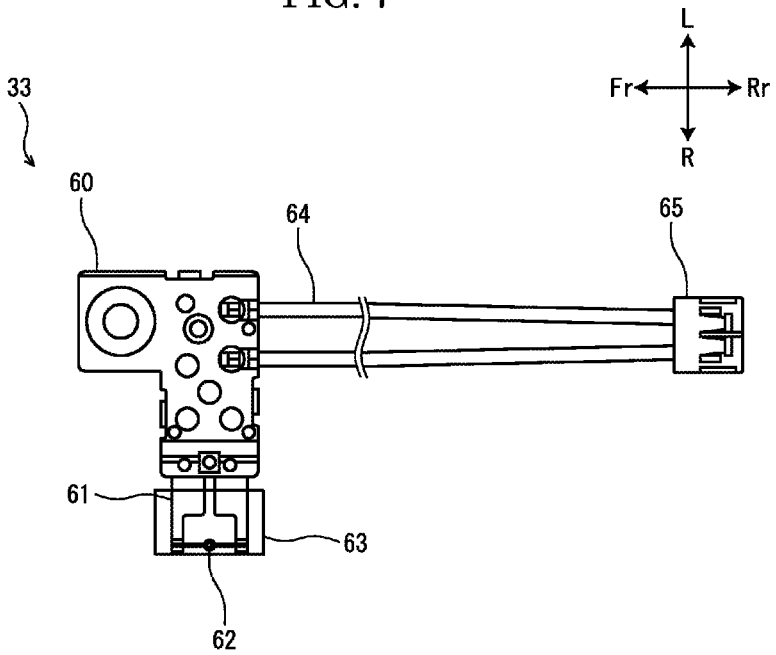
FIG. 7 is a plane view showing the thermistor of the fixing device according to the embodiment of the present disclosure.

The first thermistor 33 includes, as shown in FIGS. 5, 6 and 7 and other figures, a housing 60, two plate springs 61, a thermistor chip 62, a protection tape 63, a lead wire 64 and a connecter 65.

The housing 60 is, for example, mold-formed of resin or the like and fixed at a predetermined position on the electric component holder 32 by a screw (not shown) or the like. Each plate spring 61 is made of, for example, metal having spring performance (elasticity), such as SUS, and its distal end is slightly bent. Proximal ends of the two plate springs 61 are attached to a right end of the housing 60 at a predetermined interval and extended from the right end of the housing 60 to a right lower direction. The thermistor chip 62 is located between the distal ends of the two plate springs 61 and connected to each late spring 61. The protection tape 63 is, for example, a PI tape and is folded and pasted so as to put the distal ends of the two plate springs 61 and the thermistor chip 62 between both folded sides.

The lead wire 64 is composed of a pair of two wires, attached to the housing 60, extended from the housing 60 and wired on the electric component holder 32. The lead wire 64 is wired inside the housing 60 and electrically connected to the two plate springs 61. The connecter 65 is electrically connected to a distal end of the lead wire 64.

the first thermistor 33 configured as described above is located so that the distal ends of the two plate springs 61 conic into contact with the inner circumference face of the fixing belt 24 and the thermistor chip 62 attached to the distal ends of the two plate springs 61 senses belt temperature of the fixing belt 24. Since the two plate springs 61 have spring performance biased to the inner circumference face of the fixing belt 24, they are stably brought into contact with the inner circumference face of the fixing belt 24. Since the protection tape 63 is pasted around the distal ends of the two plate springs 61, contact abrasion of each plate spring 61 and the thermistor chip 62 is reduced.

Since the second thermistor 34 and the third thermistor 35 have the same configuration as the first thermistor 33, their descriptions are omitted.

The thermostat 36 functions as a safety element in a case where excessive temperature rise (abnormal heating) occurs in the fixing belt 24 or the belt guide 31. Since the fixing belt. 24 and the belt guide 31 comes into contact with each other, their temperature level are nearly equal in a non-sheet passing unsaturated state. However, in a temperature rise transient state or a sheet passing state, although heat on a surface of the fixing belt. 24 is taken away by the sheet and an outside air, because inside the belt guide 31 from the inner face of the belt guide 31, heat may be accumulated, taken-away heating value is decreased. Accordingly, temperature relationship of surface temperature of the fixing belt 24<inner face temperature of the belt guide 31 is caused, for example, a temperature difference between the surface temperature of the fixing belt 24 and the inner face temperature of the belt guide 31 becomes approximately 10-30 degrees.

Moreover, because the fixing belt 24 is based on a thin base material, there is a possibility that it is damaged by a flaw due to a defect or a foreign matter, meandering stress, metal fatigue and others in the base material. If the fixing belt 24 is damaged, at a lacked portion of the fixing belt 24, the magnetic flux generated by the coil 45 may heat only the belt guide 31 directly.

By contrast, considering the temperature difference between the surface temperature of the fixing belt 24 and the inner face temperature of the belt guide and safety when the fixing belt 24 is damaged, the thermostat 36 senses the inner face temperature of the belt guide 31 to detect abnormal heating of the belt guide 31 and abnormal heating of the fixing belt 24.

Figure 8:
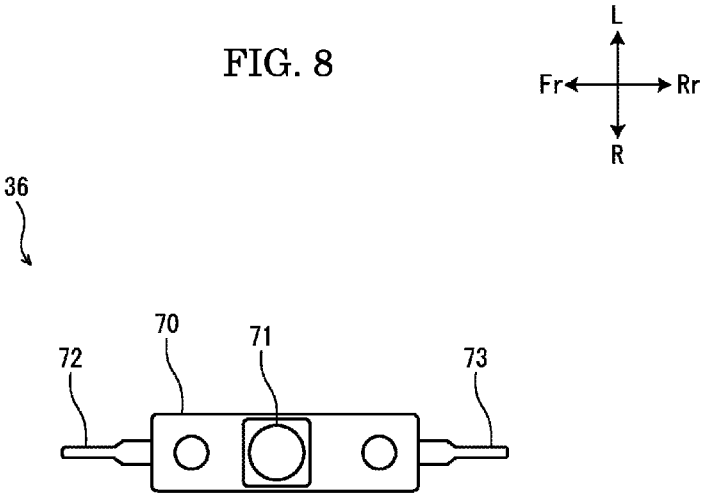
FIG. 8 is a plane view showing a thermostat of the fixing device according to the embodiment of the present disclosure.
Figure 9:
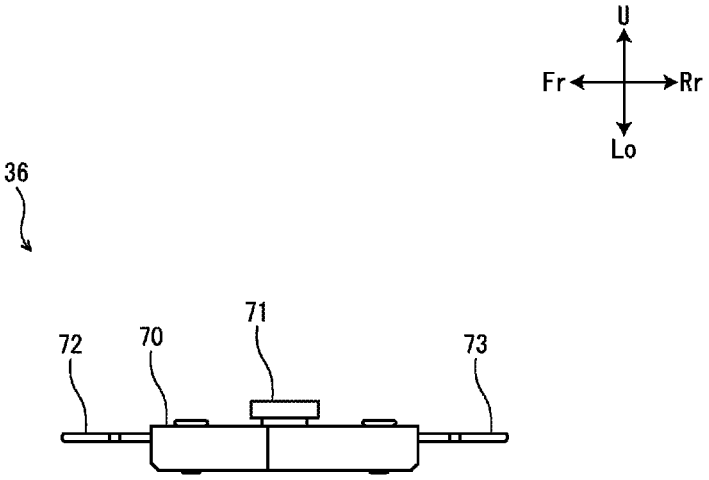
FIG. 9 is a side view showing the thermostat of the fixing device according to the embodiment of the present disclosure.

The thermostat 36 includes, as shown in FIGS. 5, 8 and 9 and other figures, a housing 70, a temperature sensing member 71, two lead terminals 72, 73 (a first lead terminal and a second lead terminal) and two lead wires 74, 75 (a first lead wire and a second lead wire). The thermostat 36 is located on the attachment plate 54 of the electric component holder 32 as described above so that the temperature sensing member 71 is arranged at a predetermined interval, e.g. an interval of 1-3 mm, from the belt guide 31.

The housing 70 is, for example, mold-formed of resin or the like and fixed onto the attachment plate 54 of the electric component holder 32 by a screw (not shown) or the like. The temperature sensing member 71 is made of, for example, a thermally sensitive member, such as bimetal, and is attached at the roughly center of the housing 70 so as to sense temperature of the belt guide 31. The two lead terminals 72 and 73 are respectively attached at both front and rear ends of the housing 70 (one end part and another end part of the housing 70 in an axial direction of the fixing belt 24) and electrically connected to the temperature sensing member 71 inside the housing 70. The two lead wires 74 and 75 are fixed and electrically connected to the two lead terminals 72 and 73 by caulking or the like.

The front lead wire 74 (the first lead wire) is wired so as to be extended to a front side (one end side in the axial direction of the fixing belt 24) and to be pulled out from the inside to the outside via the front side (one end side) in the fixing belt 24. The rear lead wire 75 (the second lead wire) is wired so as to be extended to a rear side another end side in the axial direction of the fixing belt 24) and then to be curved toward the front side (one end side in the axial direction), i.e. turned over (U-turned) in the middle. Further, the rear lead wire 75 is wired so as to be extended to the front side (one end side in the axial direction of the fixing belt 24) from the above-described curved portion 76 (a U-turned portion) and to be pulled out from the inside to the outside via the front side (one end side) in the fixing belt 24. Incidentally, the curved portion 76 of the rear lead wire 75 is not turning in an acute angle, but is configured to have a predetermined loop area, and therefore, stresses to wiring work and wiring material are reduced.

The two lead wires 74 and 75 are wired by wiring guides provided in the electric component holder 32. For example, the electric component holder 32 has a wiring guide wiring the front lead wire 74 to extend it to the front side and to pull out it from the front side to the outside of the fixing belt 24 and a wiring guide wiring the rear lead wire 75 to extend it to the rear side and then to curve it toward the front side and further to extend it to the front side and to pull out it from the front side to the outside of the fixing belt 24. The electric component holder 32 facilitates the work wiring the curved portion 76 of the rear lead wire 75 as described above and has a function maintaining a wiring pattern.

Figure 10:
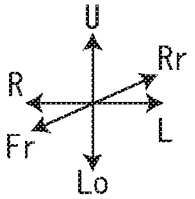
FIG. 10 is a perspective view showing an electro conductive magnetic shielding member of the fixing device according to the embodiment of the present disclosure.
Figure 10:
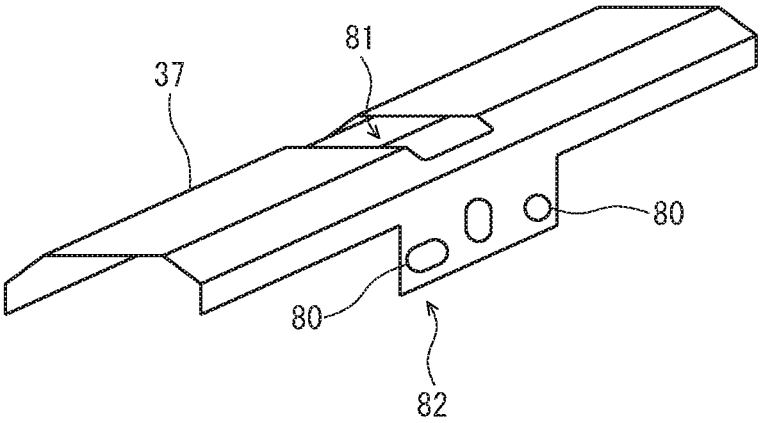
Figure 11:
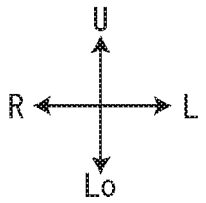
FIG. 11 is a sectional view showing a fixing device, in a state that the electro conductive magnetic shielding member of the fixing device is installed into the electrical component holder, according to the embodiment of the present disclosure.
Figure 11:
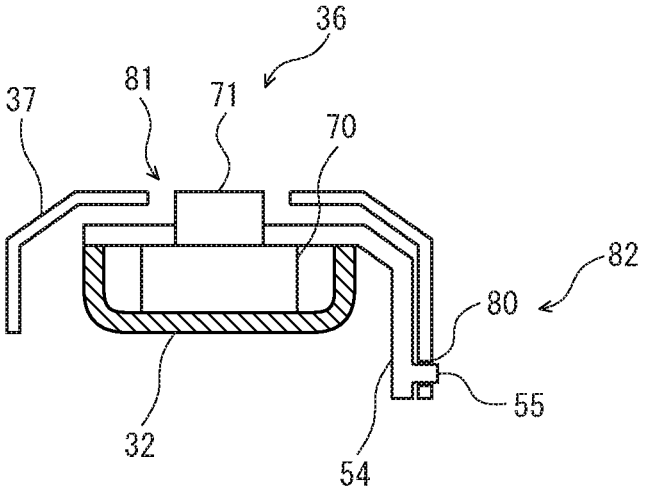

The electro conductive magnetic shielding member 37 is, as shown in FIGS. 10 and 11 and other figures, a plate member having an inversed U-formed cross section being shorter in the forward and backward directions than the electric component holder 32. The electro conductive magnetic shielding member 37 is made of a plate material of, for example, nonmagnetic SUS (SUS304 or the like) or the like having spring performance (elasticity) with a thickness of approximately 0.2-0.4 mm. In a left wall portion of the electro conductive magnetic shielding member 37, engaging holes 80 are formed. The electro conductive magnetic shielding member 37 is attached to the electric component holder 32 at least at a corresponding position to the curved portion 76 of the rear lead wire 75 of the thermostat. 36 so as to cover this curved portion 76 together with the electric component holder 32 from the upper side and both left and right sides (a side of the belt guide 31).

In a case where the electro conductive magnetic shielding member 37 covers the temperature sensing member 71 of the thermostat 36, in an upper part of the electro conductive magnetic shielding member 37, an opening portion 81 is formed at a corresponding position to the temperature sensing member 71. The engaging holes 80 of the electro conductive magnetic shielding member 37 compose a snap-fit mechanism 82 together with the engaging protruded parts 55 of the attachment plate 54 of the electric component holder 32. By engaging the engaging protruded parts 55 with the engaging holes 80 and utilizing the spring performance of the electro conductive magnetic shielding member 37, the electro conductive magnetic shielding member 37 is attached to the electric component holder 32 by snap-fit.

In accordance with the embodiment, as described above, the fixing device 18 of the printer 1 (the image forming apparatus) includes the fixing belt 24, the belt guide 31, the pressuring roller 25 (a pressuring member), the heat source 26, and the thermostat 36 (an excessive temperature rise preventing device). The fixing belt 24 is provided rotatably around a rotation axis A. The belt guide 31 is brought into contact with the inside of the fixing belt 24 to assist a rotation track of the fixing belt 24. The pressuring roller 25 is provided rotatably and brought into pressure contact with the fixing belt 24 to form a fixing nip N. The heat source 26 is located at an opposite side to the pressuring roller 25 across the fixing belt 24 separately from the fixing belt 24 to the outside and composed of a coil 45 induction-heating the fixing belt 24. The thermostat 36 is provided with respect to the belt guide 31 in a noncontact manner inside the belt guide 31, has the lead wires 74 and 75 (a first lead wire and a second lead wire) connected at its front side and its rear side (one end side and another end side in an axial direction of the fixing belt 24) and prevents excessive temperature rise of the belt guide 31. The front lead wire 74 is wired as to be extended to the front side (one end side in the axial direction of the fixing belt 24) and to be pulled out from the inside to the outside via the front side (one end side) in the fixing belt 24. The rear lead wire 75 (the second lead wire) is wired so as to be extended to the rear side (another end side in the axial direction of the fixing belt 24) and then to be curved toward the front side (one end side in the axial direction), and further, to be extended to the front side (one end side in the axial direction of the fixing belt 24) from the curved portion 76 (a U-turned portion) and to be pulled out from the inside to the outside via the front side (one end side) in the fixing belt 24.

According to this, in the fixing device 18, in a case where the electric components, such as the thermostat, is provided inside the fixing belt 24 and the belt guide 31, it is possible to reduce an area of a loop formed by wiring of the electric components. Therefore, it is possible reduce and to restrain an effect of electromagnetic noise induced by the leaked magnetic flux penetrating the inside of the fixing belt 24 and the belt guide 31 with a simple configuration.

In addition, in accordance with the embodiment, the fixing device 18 further includes the electro conductive magnetic shielding member 37 (a shielding member) covering at least the curved portion 76 of the rear lead wire 75 (the second lead wire) from the side of the belt guide 31.

On the work wiring of the rear lead wire 75, since it is necessary to secure a certain loop area of the curved portion 76, the little leaked magnetic flux caused by interlinkage with a little loop of the curved portion 76 may be remained. By contrast, by locating and inserting the electro conductive magnetic shielding member 37 between the belt, guide 31 and the curved portion 76 of the rear lead wire 75, it is possible to reduce the leaked magnetic flux interlinking with the loop of the curved portion 76 and to restrain induction of the electromagnetic noise. Incidentally, although the electro conductive magnetic shielding member 37 may be formed over the whole length in the axial direction of the fixing belt 24, because there is a little margin for a space inside the belt guide 31, if a shielding area covering at least the loop of the wiring is secured, there is no problem.

Thereupon, considering the space, cost and noise reducing effect, the electro conductive magnetic shielding member 37 is located only in the vicinity of the curved portion 76 of the rear lead wire 75. Incidentally, in another portion not-covered by the electro conductive magnetic shielding member 37, if the wiring of the two lead wires 74 and 75 is set in a roughly close contact and parallel state, the electromagnetic noise caused by the leaked magnetic flux hardly affects. This is achieved similarly in the first thermistor 33, the second thermistor 34 and the third thermistor 35 (the temperature sensing devices).

Moreover, in accordance with the embodiment, the electro conductive magnetic shielding member 37 is configured so as to cover the thermostat 36 (the excessive temperature rise preventing device) and its periphery in addition to the curved portion 76 of the rear lead wire 75 from the side of the belt guide 31 and to have the opening portion 81 at the corresponding position to the thermostat 36.

According to this, in a case where the shielding area of the electro conductive magnetic shielding member 37 is expanded to more restrain the effect of electromagnetic noise induced by the leaked magnetic flux, the thermally sensitive member, such as bimetal, of the thermostat 36 is exposed via the opening portion 81. Therefore, it is possible to actualize a configuration not affecting sensing performance of the thermostat 36 and the thermostat 36 can directly sense temperature of the belt guide with excellent responsiveness.

Further, in accordance with the embodiment, the electro conductive magnetic shielding member 37 is made of nonmagnetic SUS having a thickness of 0.2-0.4 mm, having electric conductivity and shielding magnetism.

As the shielding member, if another material, such as copper or aluminum, were applied, because electric conductivity is high too much, diamagnetic effect may cause magnetic flux cancelling the leaked magnetic flux penetrating the belt guide 31 to affect heating performance of the fixing belt 24 and the belt guide 31 and to make temperature distribution non-uniformly. By contrast, the electro conductive magnetic shielding member 37 made of nonmagnetic SUS can shield the leaked magnetic flux without affecting the heating performance of the fixing belt 24 and the belt guide 31. Moreover, since the electro conductive magnetic shielding member 37 has the thickness of 0.2-0.4 mm, it is possible to establish both spring performance (elasticity) and magnetism shielding performance in an appropriate balance.

Furthermore, in accordance with the embodiment, the fixing device 18 further includes the electric component holder 32 (a holder) provided at an inner diameter side of the fixing belt 24. The electric component holder 32 wires the front lead wire 74 to extend it to the front side and to pull out it from the front side to the outside of the fixing belt 24 and wires the rear lead wire 75 to extend it to the rear side and then to curve it toward the front side and further to extend it to the front side and to pull out it from the front side to the outside of the fixing belt 24.

According to this, it is possible to facilitate the work wiring the curved portion 76 of the rear lead wire 75 and to maintain the wiring pattern with a simple configuration.

Moreover, in accordance with the embodiment, the electro conductive magnetic shielding member 37 and the electric component holder 32 includes the snap-fit mechanism 82 and the electro conductive magnetic shielding member 37 has spring performance and is attached to the electric component holder 32 by the snap-fit mechanism 82.

According to this, by the simple snap-fit mechanism 82 utilizing the spring performance of the electro conductive magnetic shielding member 37, it is possible to attach the electro conductive magnetic shielding member 37 to the electric component holder 32.

The embodiment was described in a case of applying the configuration of the present disclosure to the printer 1. On the other hand, in another embodiment, the configuration of the disclosure may be applied to another image forming apparatus, such as a copying machine, a facsimile or a multifunction peripheral.

Further, the above-description of the embodiments was described about one example of the image forming apparatus including this according to the present disclosure. However, the technical scope of the present disclosure is not limited to the embodiments. Components in the embodiment described above can be appropriately exchanged with existing components, and various variations including combinations with other existing components are possible. The description of the embodiment described above does not limit the content of the disclosure described in the claims.

What is claimed is:

1. A fixing device comprising:

a fixing belt provided rotatably around a rotation axis;

a belt guide brought into contact with the inside of the fixing belt to assist a rotation track of the fixing belt;

a pressuring member provided rotatably and brought into pressure contact with the fixing belt to form a fixing nip;

a heat source located at an opposite side to the pressuring member across the fixing belt separately from the fixing belt to the outside and composed of a coil induction-heating the fixing belt;

an excessive temperature rise preventing device provided with respect to the belt guide in a noncontact manner inside the belt guide, having a first lead wire and a second lead wire connected at one end side and another end side in an axial direction of the fixing belt and preventing excessive temperature rise of the belt guide; and a shielding member covering at least the curved portion of the second lead wire from the side of the belt guide, wherein the first lead wire is wired as to be extended to one end side in the axial direction of the fixing belt and to be pulled out from the inside to the outside via one end side in the fixing belt, the second lead wire is wired so as to be extended to another end side in the axial direction of the fixing belt and then to be curved toward one end side in the axial direction, and further, to be extended to one end side in the axial direction of the fixing belt and to be pulled out from the inside to the outside via one end side in the fixing belt, and the shielding member is made of nonmagnetic SUS having a thickness of 0.2-0.4 mm, having electric conductivity and shielding magnetism.

2. The fixing device according to claim 1, wherein the shielding member is configured so as to cover the excessive temperature rise preventing device and its periphery in addition to the curved portion of the second lead wire from the side of the belt guide and to have the opening portion at the corresponding position to the excessive temperature rise preventing device.

3. The fixing device according to claim 1 further comprising: a holder provided at an inner diameter side of the fixing belt, wiring the first lead wire to extend it to one end side in the axial direction of the fixing belt and to pull out it from one end side to the outside of the fixing belt and wiring the second lead wire to extend it to another end side in the axial direction and then to curve it toward one end side and further to extend it to one end side and to pull out it from one end side to the outside of the fixing belt.

4. The fixing device according to claim 3, wherein the shielding member and the holder includes a snap-fit mechanism and the shielding member has spring performance and is attached to the holder by the snap-fit mechanism.

5. The fixing device according to claim 1 further comprising;

one temperature sensor for main control of belt temperature of the fixing belt attached in the vicinity of the center in a width direction of a sheet passing through the fixing belt;

another temperature sensor attached at a corresponding position to a non-sheet passing area of the sheet of a maximum size passing through the fixing belt, monitoring temperature of the non-sheet passing area and preventing excessive temperature rise; and an attachment plate provided between one temperature sensor and another temperature sensor, wherein the excessive temperature rise preventing device is attached to the attachment plate.

6. The fixing device according to claim 1, wherein the second lead wire is configured so that the curved portion extended to another end side in the axial direction and then curved toward one end side in the axial direction has a predetermined loop area.

7. An image forming apparatus comprising the fixing device according to claim 1.

8. An image forming apparatus comprising the fixing device according to claim 2.

9. An image forming apparatus comprising the fixing device according to claim 3.

10. An image forming apparatus comprising the fixing device according to claim 4.

11. An image forming apparatus comprising the fixing device according to claim 5.

12. An image forming apparatus comprising the fixing device according to claim 6.

* * * * *